US007446738B2

(12) United States Patent
Kasai

(10) Patent No.: US 7,446,738 B2
(45) Date of Patent: Nov. 4, 2008

(54) ELECTRONIC CIRCUIT, ELECTRO-OPTICAL DEVICE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 115 days.

(21) Appl. No.: 10/629,592

(22) Filed: Jul. 30, 2003

(65) Prior Publication Data

US 2006/0187156 A1 Aug. 24, 2006

(30) Foreign Application Priority Data

Jul. 31, 2002 (JP) ..... 2002-223157
Jul. 16, 2003 (JP) ..... 2003-198127

(51) Int. Cl.
*G09G 3/30* (2006.01)

(52) U.S. Cl. ..... 345/76; 345/77

(58) Field of Classification Search ..... 345/204, 345/690–695, 87–100, 76–89, 90–101, 589–605; 315/169.3; 430/139
See application file for complete search history.

(56) References Cited

U.S. PATENT DOCUMENTS

| | | | | |
|---|---|---|---|---|
| 5,089,812 | A * | 2/1992 | Fuse et al. | 345/89 |
| 5,212,481 | A | 5/1993 | Ichihara | |
| 6,191,535 | B1 * | 2/2001 | Saitou | 315/169.3 |
| 6,323,880 | B1 * | 11/2001 | Yamada | 345/690 |
| 6,452,590 | B1 * | 9/2002 | Awamoto et al. | 345/211 |
| 6,462,722 | B1 | 10/2002 | Kimura et al. | |
| 6,522,315 | B2 | 2/2003 | Ozawa et al. | |
| 6,747,669 | B1 | 6/2004 | Yamaguchi et al. | |
| 7,215,366 | B2 * | 5/2007 | Mori et al. | 348/223.1 |
| 2002/0109702 | A1 | 8/2002 | Kobayashi | |
| 2003/0197705 | A1 * | 10/2003 | Kawai et al. | 345/505 |

FOREIGN PATENT DOCUMENTS

| | | | |
|---|---|---|---|
| CN | 1217806 | A | 5/1999 |
| EP | DP 1 288 905 | A2 | 3/2003 |
| JP | A-03-228434 | | 10/1991 |
| JP | A-05-028647 | | 2/1993 |
| JP | 05-151793 | A | 6/1993 |
| JP | A-06-314977 | | 8/1994 |
| JP | A-07-036405 | | 2/1995 |
| JP | A-07-049667 | | 2/1995 |
| JP | A-08-032837 | | 2/1996 |
| JP | 08-249818 | A | 9/1996 |
| JP | A-09-044185 | | 2/1997 |
| JP | A-10-313418 | | 11/1998 |
| JP | A-10-319922 | | 12/1998 |
| JP | A-11-288243 | | 10/1999 |
| JP | A-2000-056727 | | 2/2000 |

(Continued)

*Primary Examiner*—Nitin Patel
(74) *Attorney, Agent, or Firm*—Oliff & Berridge, PLC

(57) ABSTRACT

To provide an electronic circuit, an electro-optical device, and an electronic apparatus, which are capable of producing digital signals having predetermined output values in accordance with digital data. A bit extending circuit 40 is constructed for producing 8-bit digital data in order to change current Im of data line driving signals output from a digital-to-analog converting circuit 30 in a manner of a high order function with respect to 6-bit image data output from a controller. Further, a single line driver 20 is constructed by connecting the bit extending circuit 40 to an input side of the digital-to-analog converting circuit 30.

11 Claims, 8 Drawing Sheets

FOREIGN PATENT DOCUMENTS

| | | |
|---|---|---|
| JP | A-2000-111866 | 4/2000 |
| JP | 2001-092404 | 4/2001 |
| JP | A-2001-092413 | 4/2001 |
| JP | A-2001-343957 | 12/2001 |
| JP | A 2002-140030 | 5/2002 |
| KR | 2001-0050603 | 6/2001 |
| WO | WO98/36407 | 8/1998 |

* cited by examiner

ELECTRONIC CIRCUIT, ELECTRO-OPTICAL DEVICE, AND ELECTRONIC APPARATUS

BACKGROUND OF THE INVENTION

1. Field of Invention

The present invention relates to an electronic circuit, an electro-optical device, and an electronic apparatus.

2. Description of Related Art

One of the conventional methods of driving an electro-optical device including electro-optical elements, such as liquid crystal elements and organic EL elements is an active matrix driving method. For example, a method is disclosed in the Pamphlet of International Patent Publication Number WO98/36407.

It is known that the visual sense of human beings is made in a manner of a high order function with respect to the luminance gray scale. Specifically, the visual sense of human beings is drastically weakened as the luminance gray scale is growing higher. Therefore, even though the luminance gray scale of the organic EL elements is constructed to change linearly with respect to the image data, the change of the luminance gray scale of the organic EL elements is not accurately perceived by the human beings as the luminance gray scale is growing higher. For the reason, in case of the luminance gray scale being linearly constructed, the gray scale number perceived by human beings seems to be lower than that of a real output, so that the resulting display quality may be deteriorated.

SUMMARY OF THE INVENTION

The present invention is contrived to solve the above problems, and an object of the present invention is to provide an electronic circuit, an electro-optical device, and an electronic apparatus, which are capable of producing digital signals having predetermined output values in accordance with digital data.

The electronic circuit of the present invention can include a shift circuit for shifting j-bit digital data (j is a natural number) to convert it into k-bit digital data (k is a natural number), and a correction circuit that is electrically coupled to the shiftcircuit. The correction circuit continuously charges the k-bit digital data which is obtained by the shift circuit in accordance with the change of the j-bit digital data. By doing so, the k-bit digital data generated based on the j-bit digital data can be arbitrarily changed.

In the electronic circuit, the k-bit digital data can be extended digital data which is larger than the j-bit digitaldata, and the shift circuit classifies a range of the j-bit digital data into a plurality of groups and shifts the digital data of each group by a predetermined number of bits in accordance with each group to convert it into the k-bit digital data. By doing so, the j-bit digital data can be converted into the k-bit digital data which changes in a manner of a high order function.

In the electronic circuit, the correction circuit can be electrically coupled to electro-opticalelements. The j-bit digital data can be luminance gray scale data for controlling the luminance of the electro-optical elements; and the k-bit digital data is extended luminance gray scale data for providing the amount of analog current, which is supplied to the electro-optical elements. By doing so, the luminance gray scale of the electro-optical elements can be arbitrarily changed by the j-bit luminance gray scale data.

In the electronic circuit, the correction circuit can be an adder. By doing so, the correction circuit can be easily constructed.

In the electronic circuit, the shift circuit can determine the number of bits by which the j-bit digital data is shifted in accordance with the size of the j-bit digital data. By doing so, the k-bit digital data generated based on the j-bit digital data can be arbitrarily changed.

In the electronic circuit, the k-bit digital data is extended digital data which is larger than the j-bit luminance gray scaledata, and the shift circuit classifies a range of the j-bit digital data into a plurality of groups and shifts the digital data of each group by a predetermined number of bits in accordance with each group to convert it into the k-bit digital data. By doing so, the j-bit digital data can be converted into the k-bit digital data which changes in a manner of a high order function.

In the electronic circuit, the shift circuit performs shifting to the upper side so that a larger value group is shifted by a larger number of bits. By doing so, it is possible to obtain the k-bit extended luminance gray scale data that rapidly increases with respect to the size of the j-bit luminance gray scale data.

The electro-optical device of the present invention can include a control circuit for outputting j-bit luminance gray scale data (j is a naturalnumber), a driving circuit for generating analog driving signals based on the j-bit luminance gray scaledata, and a pixel circuit for driving current driven elements based on the analog drivingsignals. The driving circuit can include a shift circuit for shifting the j-bit luminance gray scale data to convert it into k-bit digital data (k is a natural number), a correction circuit that is electrically coupled to the shift circuit, the correction circuit continuously changing the k-bit digital data which is obtained by the shift circuit in accordance with the change of the j-bit luminance gray scale data. By doing so, the k-bit luminance gray scale data generated based on the j-bit luminance gray scale data can be arbitrarily changed.

In the electro-optical device, the k-bit digital data is extended digital data which is larger than the j-bit luminance gray scaledata, and the shift circuit classifies a range of the j-bit digital data into a plurality of groups and shifts the digital data of each group by a predetermined number of bits in accordance with each group to convert it into the k-bit digital data. By doing so, it is possible to change an amount of the analog current which is supplied to the current driven elements in a manner of a high order function.

In the electro-optical device, the correction circuit is an adder. By doing so, the correction circuit of the electro-optical device can be easily constructed.

In the electro-optical device, the shift circuit can determine the number of bits by which the j-bit luminance gray scale data are shifted in accordance with the size of the j-bit luminance gray scale data. By doing so, it is possible to implement the electro-optical device which can control the luminance gray scale of the current driven elements based on the j-bit luminance gray scale data.

In the electro-optical device, the shift circuit performs shifting to the upper side so that a larger value group is shifted by a larger number of bits. By doing so, it is possible to obtain the k-bit extended luminance gray scale data that rapidly increases with respect to the size of the j-bit luminance gray scale data. As a result, in the electro-optical device, even in the regions having particularly high luminance gray scale, the luminance gray scale of the current driven elements can be accurately perceived by human beings. Therefore, it is possible to improve the display quality of the electro-optical device.

In the electro-optical device, the current driven elements can be EL elements. By doing so, the luminance gray scale of the EL elements can be accurately perceived by human beings.

In the electro-optical device, the EL elements can include light emitting layers made from organic materials. By doing so, the luminance gray scale of the organic EL elements can be accurately perceived by human beings.

A first electronic apparatus of the present invention can be constructed with the aforementioned electronic circuits being mounted thereon. By doing so, it is possible to provide an electronic apparatus having a display unit having excellent display quality.

The first electronic apparatus of the present invention can be constructed with the aforementioned electro-optical devices being mounted thereon. By doing so, it is possible to provide an electronic apparatus comprising a display unit having excellent display quality.

BRIEF DESCRIPTION OF THE DRAWINGS

This invention will be described with reference to the accompanying drawings, wherein like numerals reference like elements, and wherein.

DETAILED DESCRIPTION OF PREFERRED EMBODIMENTS

Figure 1:
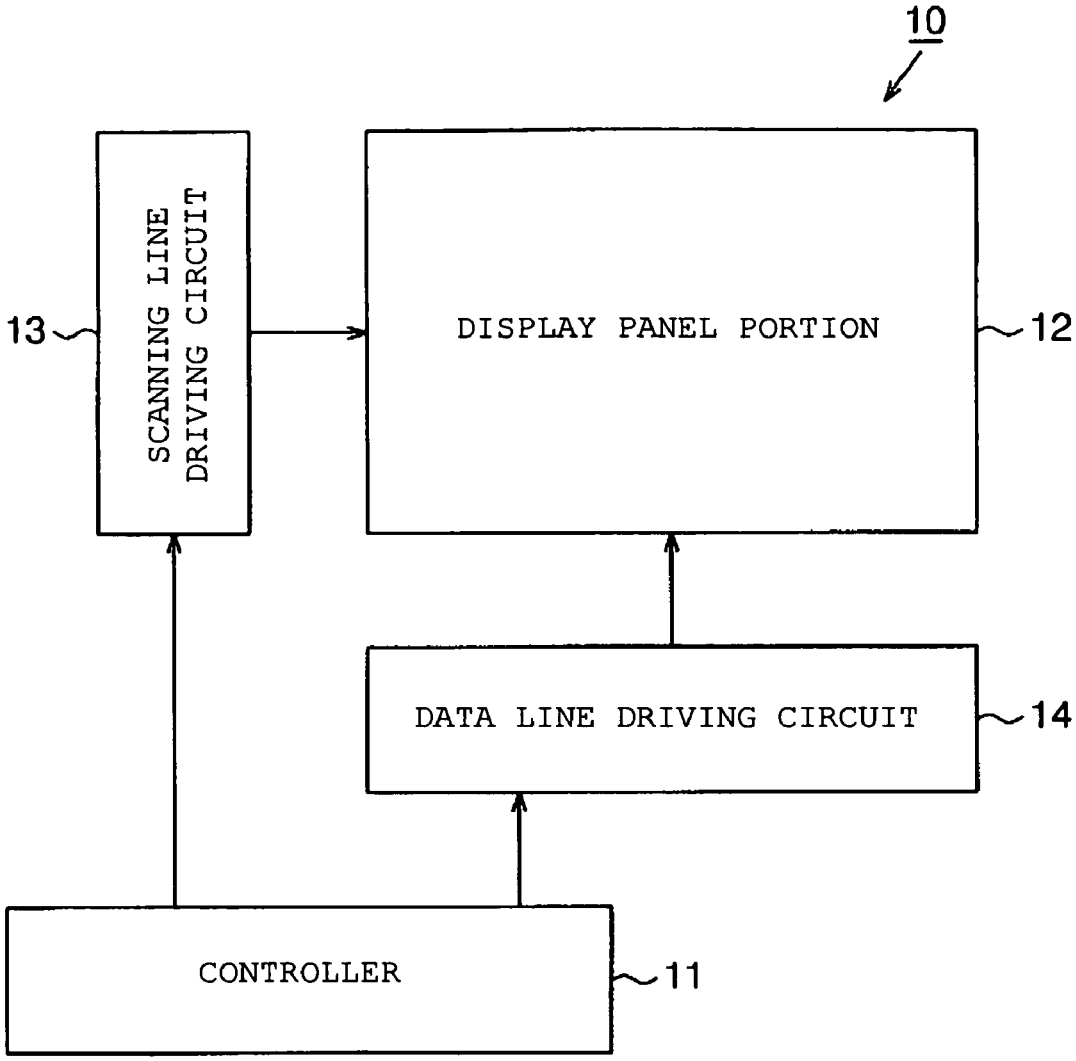
FIG. 1 is an exemplary block circuit diagram illustrating circuit construction of an organic EL display of the present embodiment.
Figure 2:
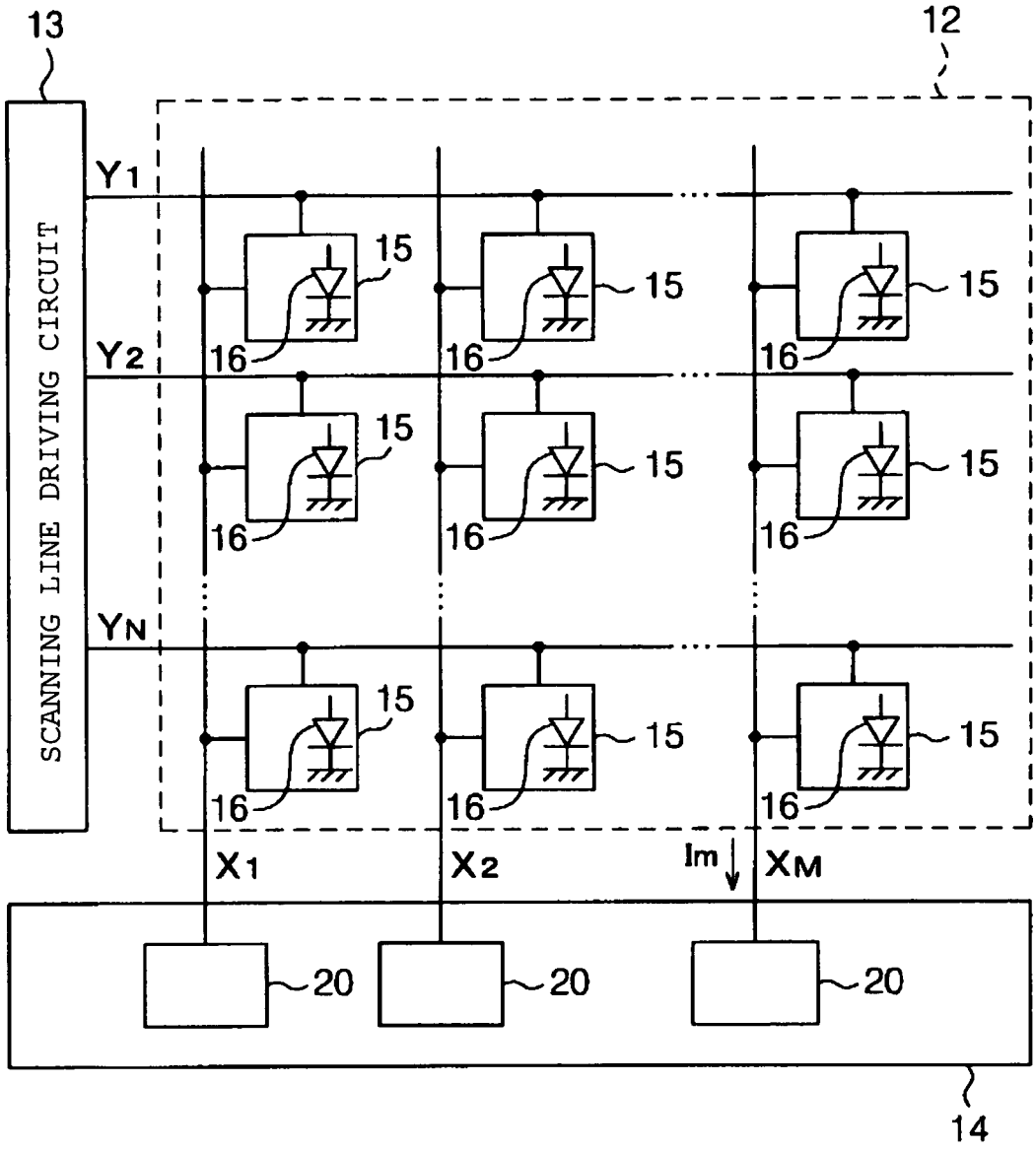
FIG. 2 is an exemplary block circuit diagram illustrating internal circuit construction of a display panel portion.

Now, the first embodiment of implementing the present invention will be described with reference to FIGS. 1 to 9. FIG. 1 shows an exemplary block circuit diagram illustrating circuit construction of an organic EL display 10 as an electro-optical device. FIG. 2 shows a block circuit diagram illustrating internal circuit construction of a display panel portion. The organic EL display 10 can include a controller 11 as a control circuit, a display panel portion 12, a scanning line driving circuit 13, and a data line driving circuit 14 as a driver circuit. Further, the organic EL display 10 in this embodiment is an active matrix driving type organic EL display.

In the organic EL display 10, the controller 11, the scanning line driving circuit 13, and the data line driving circuit 14 may be constructed with an independent electronic part, respectively. For example, the controller 11, the scanning line driving circuit 13, and the data line driving circuit 14 may be constructed with one chip of a semiconductor integrated circuit device, respectively. Further, all or some of the controller 11, scanning line driving circuit 13, and data line driving circuit 14 may be constructed with programmable IC chips so that their functions can be implemented by programs written in the IC chips in a software manner.

The controller 11 outputs control signals for executing display on the display panel portion 12 and j-bit (6-bit in this embodiment) digital data (image data as luminance gray scale data) to the scanning line driving circuit 13 and the data line driving circuit 14, respectively. Further, in this embodiment, the image data is 6-bit digital signals for convenience of explanation.

The display panel portion 12 has the construction that a plurality of pixel circuits 15 are arranged in a matrix shape, as shown in FIG. 2. Each of the pixel circuits 15 is connected to the scanning line driving circuit 13 through a plurality of scanning lines Yn (n=1 to N; n is an integer) which extend in the row direction. Further, each of the pixel circuits 15 is connected to the data line driving circuit 14 through a plurality of data lines Xm (m=1 to M; m is an integer) which is extending in the column direction. Each of the pixel circuits 15 has an organic EL element 16 as an electro-optical element in which a light emitting portion is made of organic materials.

The pixel circuits 15 are current-programmed type pixel circuits which control the luminance gray scale of the organic EL elements 16 in accordance with the current Im of the data line driving signals as driving signals output from the data line driving circuit 14. Specifically, each of the pixel circuits 15 includes, in the internal portion thereof, an electronic circuit which applies current having a current value corresponding to the current value of the data line driving signals output from the data line driving circuit 14 to the organic EL elements 16. Further, in each of the pixel circuits 15, the luminance gray scale of the organic EL elements 16 is controlled by flow of the current corresponding to the current values of the data line driving signals through the organic EL elements 16.

The scanning line driving circuit 13 selects one scanning line among the plurality of the scanning lines Yn provided to the display panel portion 12 based on the image data output from the controller 11, and outputs the scanning line driving signals to the selected scanning line. And then, the timing at which the organic EL elements 16 of the pixel circuits 15 emits light is controlled in accordance with the scanning line driving signals.

The data line driving circuit 14 generates data line driving signals based on the 6-bit image data output from the controller 11. Specifically, the data line driving circuit 14 can include a plurality of single line drivers 20 of which are connected to each of the data lines Xm. Each of the single line drivers 20 generates data line driving signals based on the image data output from the controller 11, and outputs the generated data line driving signals to each of the pixel circuits 15 through the data lines Xm. Further, in each of the pixel circuits 15, the luminance gray scale of the organic EL elements 16 is controlled by applying the current corresponding to the current Im of the data line driving signals to the organic EL elements 16. Further, in this embodiment, the luminance gray scale of the organic EL elements 16 is controlled in 64 gray scales based on the 6-bit image data output from the controller 11.

Figure 3:
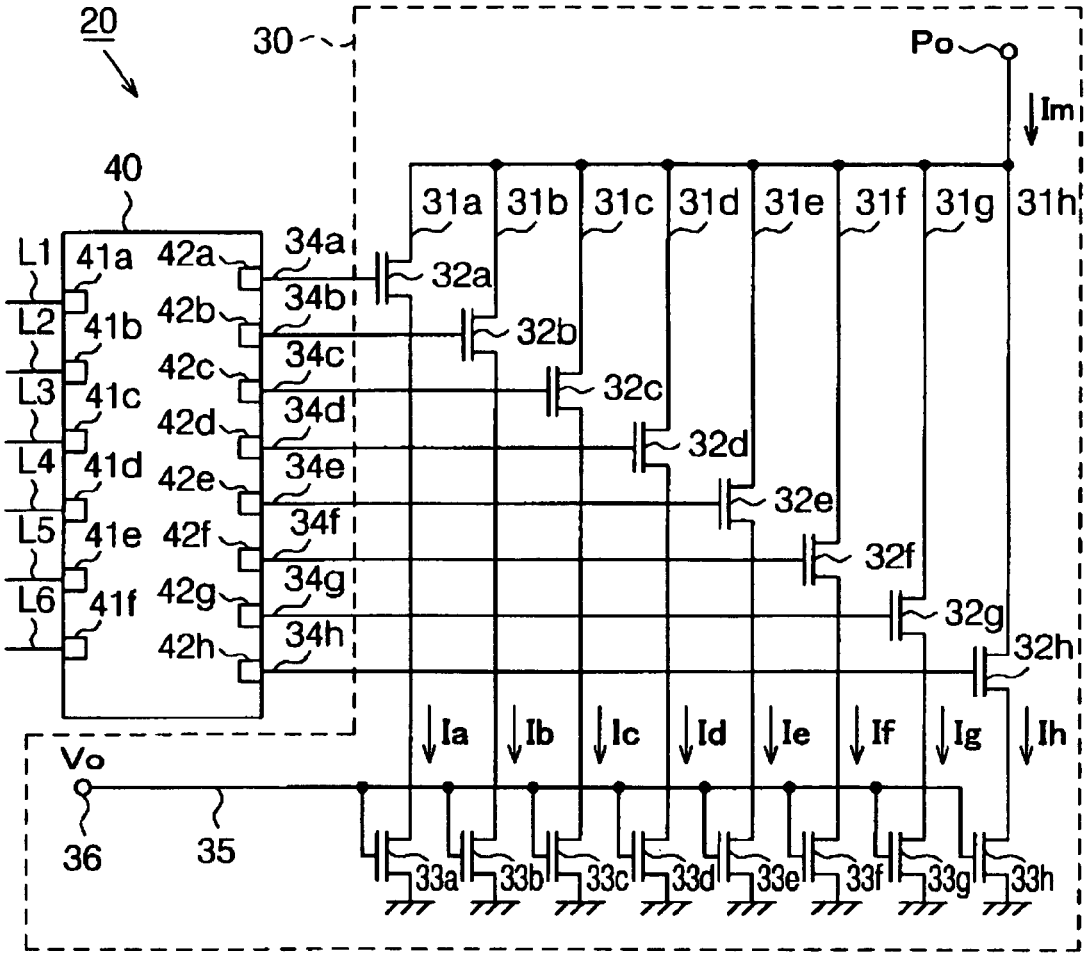
FIG. 3 is a circuit diagram illustrating a digital-to-analog circuit and a bit extending circuit which constitutes a single line driver.

Each of the single line drivers 20 includes a digital-to-analog converting circuit 30 as a driving circuit and a bit extending circuit 40 as an electronic circuit provided at the input side of the digital-to-analog converting circuit 30, as shown in FIG. 3. The digital-to-analog converting circuit 30 is an 8-bit current output type digital-to-analog converting circuit. The digital-to-analog converting circuit 30 can include analog signal lines 31*a* to 31*h*, eight switching transistors, that is, the first to eighth switching transistors 32*a* to 32*h*, eight current supplying transistors, that is, the first to eighth current supplying transistors 33*a* to 33*h*, and digital input signal lines 34*a* to 34*h*.

The analog signal lines 31*a* to 31*h* can be arranged in parallel to each other and connected to an analog output terminal Po. Each of the analog signal lines 31*a* to 31*h* is connected to each of the drains of the first to eighth switching transistors 32*a* to 32*h*.

Each of the sources of the first to eighth switching transistors 32*a* to 32*h* is connected to each of the drains of the first to eighth current supplying transistors 33*a* to 33*h*. Further, each of the gates of the first to eighth switching transistors 32*a* to 32*h* is connected to the bit extending circuit 40 through each of the first to eighth digital input signal lines 34*a* to 34*h*.

Each of the gates of the first to eighth current supplying transistors 33*a* to 33*h* is connected to an input terminal 36 through a voltage supplying line 35. Further, each of the first to eighth current supplying transistors 33*a* to 33*h* outputs each of current having predetermined current values when a reference voltage Vo is applied to the input terminal 36. In other words, each of the first to eighth current supplying transistors 33*a* to 33*h* is a transistor serving as a constant current source for outputting a predetermined current.

Specifically, relative ratio of gain coefficients β of the first to eighth current supplying transistors 33*a* to 33*h* is set to be 1:2:4:8:16:32:64:128, respectively. The gain efficient β of the transistor is defined as $\beta=(\mu CW/L)$, where μ is mobility of carrier, C is gate capacitance, W is channel width, and L is channel length. Therefore, the ratio of current driving capabilities of the first to eighth current supplying transistors 33*a* to 33*h* becomes 1:2:4:8:16:32:64:128, and the magnitudes Ia to Ih of the current output from the first to eighth current supplying transistors 33*a* to 33*h* have the following relationship.

$$Ia=Ib/2=Ic/4=Id/8=Ie/16=If/32=Ig/64=Ih/128$$

Further, the ON/OFF control of the first to eighth switching transistors 32*a* to 32*h* is performed by 8-bit digital data as k-bit extended digital data output from the bit extending circuit 40. The lowest bit of the 8-bit digital data is supplied to the first switching transistors 32*a* having the smallest gain efficient (in which the relative value of β is 1), and the highest bit is output to the eighth switching transistors 32*h* having the largest gain efficient (in which the relative value of β is 128).

The analog output terminal Po of the digital-to-analog converting circuit 30 is connected to each of the pixel circuits 15 through each of the data lines Xm (m=1 to M). Further, the digital-to-analog converting circuit 30 outputs the current Im of the data line driving signals proportional to the digital data output from the bit extending circuit 40 at the analog output terminal Po.

Figure 4:
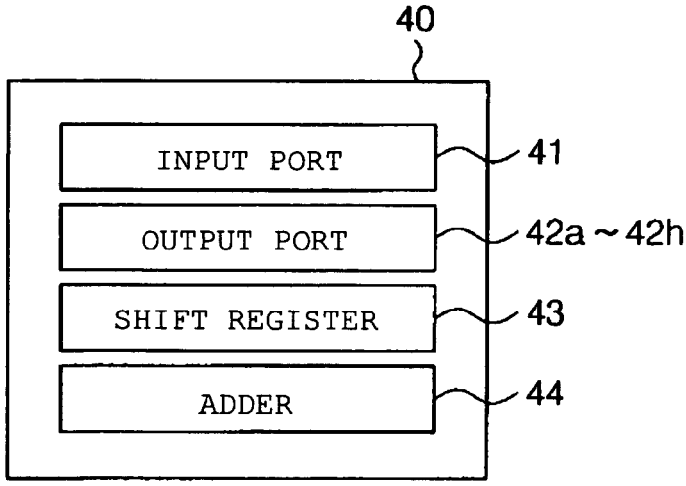
FIG. 4 is a constructional view of the bit extending circuit.

The bit extending circuit 40 can include input port 41, first to eighth output ports 42*a* to 42*h*, shift register 43 as a bit shift circuit, and an adder 44, as shown in FIG. 4.

The input port 41 is connected to the controller 11 through data lines L1 to L6. Each of the input ports 41*a* to 41*f* inputs the 6-bit image data output from the controller 11 through the data lines L1 to L6 to the bit extending circuit 40.

The first to eighth output ports 42*a* to 42*h*, in the sequence of the first output port 42*a*, the second output port 42*b*, . . . , and the eighth output port 42*h*, are connected to the first digital input signal line 34*a*, the second digital input signal line 34*b*, . . . , and the eighth digital input signal line 34*h*, respectively. Further, each of the first to eighth output ports 42*a* to 42*h* is connected to each of the gates of the first to eighth switching transistors 32*a* to 32*h* through each of the first to eighth digital input signal lines 34*a* to 34*h*. Further, the first to eighth output ports 42*a* to 42*h*, in the sequence of the first output port 42*a*, the second output port 42*b*, . . . , and the eighth output port 42*h*, are set to correspond the sequence from the lowest bit to the highest bit of the 8-bit digital data processed in the shift register 43 and the adder 44, described later. Furthermore, in this embodiment, the aforementioned digital data is the extended digital data and extended luminance gray scale data.

The shift register 43, which is constructed with a plurality of logic circuits, is a circuit that extends the 6-bit image data output from the controller 11 to the 8-bit digital data and at the same time shifts each bit of the extended 8-bit digital data.

The adder 44 is a circuit for adding predetermined 8-bit data values to the image data which is shifted by the shift register 43.

Figure 6:
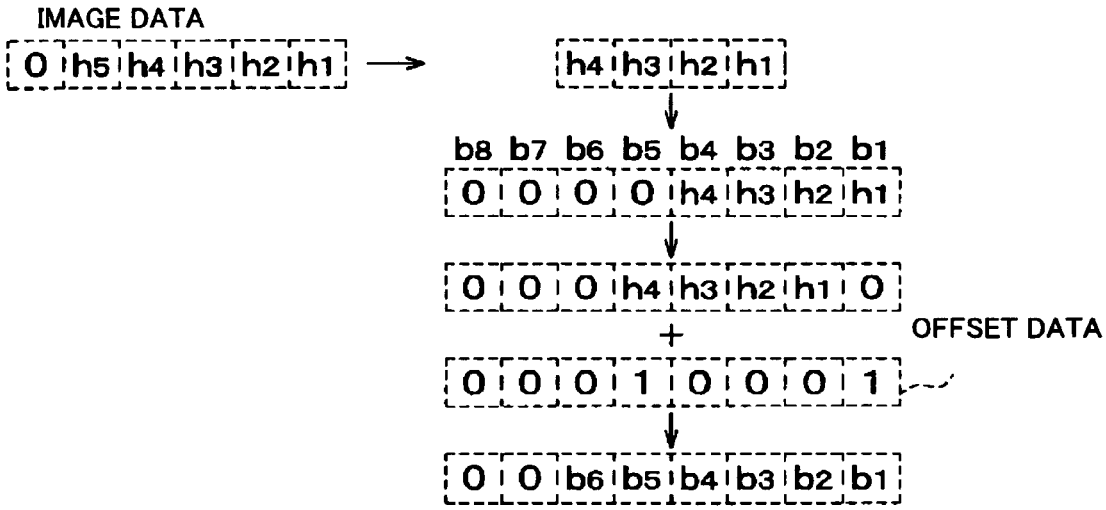
FIG. 6 is a view for explaining an operational processing method which is executed in the bit extending circuit.
Figure 7:
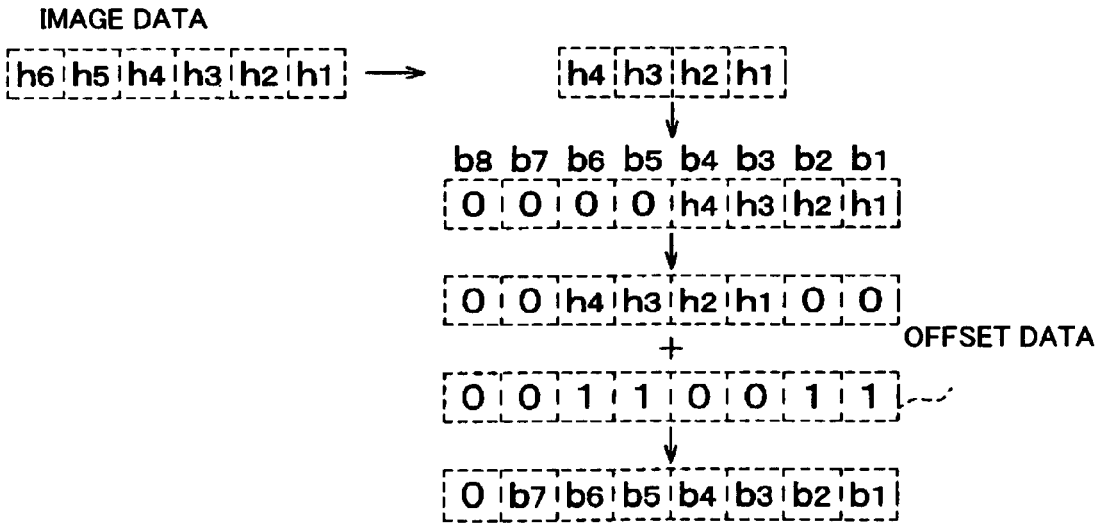
FIG. 7 is a view for explaining an operational processing method which is executed in the bit extending circuit.
Figure 8:
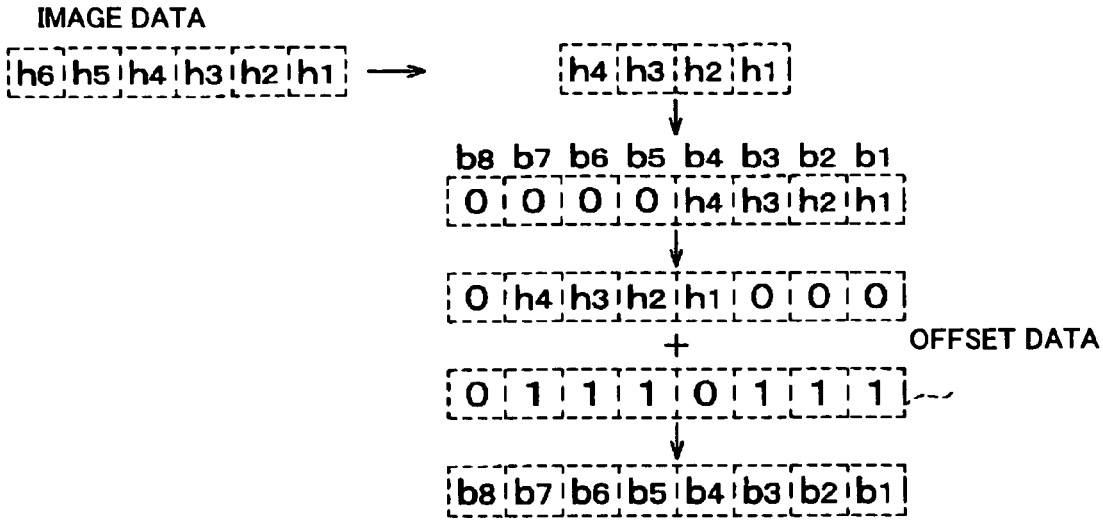
FIG. 8 is a view for explaining an operational processing method which is executed in the bit extending circuit.

Next, the method of operational processing which is executed at the bit extending circuit 40 will be described with reference to FIGS. 5 to 7. Further, the value of each bit of the image data output from the controller 11 is indicated as hi (i=1 to 6), for convenience.

In this embodiment, the bit extending circuit 40 performs operational processing on the 6-bit image data (h6, h5, h4, h3, h2, h1) output from the controller 11, while dividing h1 to h6 into four groups. Now, each of the groups will be described.

1. First Group

The first group is a group of the case (gray scale 1 to 16) that the image data is (0, 0, 0, 0, 0, 0) to (0, 0, 1, 1, 1, 1).

Figure 5:
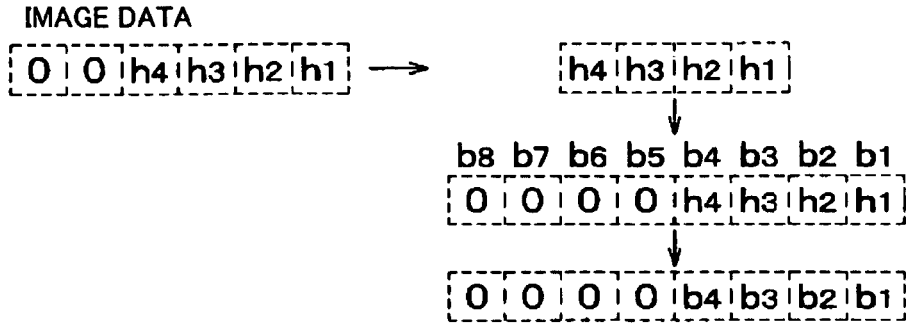
FIG. 5 is a view for explaining an operational processing method which is executed in the bit extending circuit.

The bit extending circuit 40, by means of the shift register 43 thereof, extracts the low four bits among the 6-bit image data (0, 0, h4, h3, h2, h1), adds four bits (0, 0, 0, 0) to the upper side of the low four-bits, and generates 8-bit image data (0, 0, 0, 0, h4, h3, h2, h1) (see FIG. 5). And then, the 8-bit image data (0, 0, 0, 0, h4, h3, h2, h1) is output from each of the first to eighth output ports 42*a* to 42*h* as extended 8-bit image data (0, 0, 0, 0, b4, b3, b2, b1), as it is.

2. Second Group

The second group is a group of the case (gray scale 17 to 32) that the image data is (0, 1, 0, 0, 0, 0) to (0, 1, 1, 1, 1, 1).

The bit extending circuit 40, by means of the shift register 43 thereof, extracts the low four bits among the 6-bit image data (0, h5, h4, h3, h2, h1), adds four bits (0, 0, 0, 0) to the upper side of the low four bits, and generates 8-bit image data (0, 0, 0, 0, h4, h3, h2, h1). Next, the shift register 43 shifts the values 'h1' to 'h4', the low four bits of the 8-bit image data (0, 0, 0, 0, h4, h3, h2, h1), by one bit to the left side so as to make the lowest bit be '0' (see FIG. 6). Subsequently, in the adder 44, a previously stored 8-bit data (0, 0, 0, 1, 0, 0, 0, 1) is added to the 8-bit image data (0, 0, 0, h4, h3, h2, h1, 0) which is shifted by the shift register 43. The 8-bit data (0, 0, 0, 1, 0, 0, 0, 1) is offset data and corresponds to offset values for applying the initial values of the 8-bit image data (0, 0, 0, h4, h3, h2, h1, 0) which is shifted by the shift register 43. In other words, the offset data is the data for ensuring continuity between the first and second groups. Further, each of the added 8-bit digital data is output from each of the output ports 42*a* to 42*h* as the extended 8-bit image data [b8 (=0), b7 (=0), b6, b5, b4, b3, b2, b1 (=1)].

3. Third Group

The third group is a group of the case (gray scale 33 to 48) that the image data is (1, 0, 0, 0, 0, 0) to (1, 0, 1, 1, 1, 1).

The bit extending circuit 40, by means of the shift register 43 thereof, extracts the low four bits among the 6-bit image data (h6, h5, h4, h3, h2, h1), adds four bits (0, 0, 0, 0) to the upper side of the low four bits, and generates 8-bit image data (0, 0, 0, 0, h4, h3, h2, h1). Next, the shift register 43 shifts the values 'h1' to 'h4', the low four bits of the 8-bit image data (0, 0, 0, 0, h4, h3, h2, h1), by two bits to the left side so as to make the low two bits be (0, 0) (see FIG. 7). Subsequently, in the adder 44, a previously stored 8-bit data (0, 0, 1, 1, 0, 0, 1, 1) is added to the 8-bit image data (0, 0, h4, h3, h2, h1, 0, 0) which is shifted by the shift register 43. The 8-bit data (0, 0, 1, 1, 0, 0, 1, 1) is offset data and corresponds to offset values for applying the initial values of the 8-bit image data (0, 0, h4, h3, h2, h1, 0, 0) which is shifted by the shift register 43. In other words, the offset data is the data for ensuring continuity between the second and third groups. Further, each of the added 8-bit digital data is output from each of the output ports 42*a* to 42*h* as the extended 8-bit image data [b8 (=0), b7, b6, b5, b4, b3, b2 (=1), b1 (=1)].

4. Fourth Group

The fourth group is a group of the case (gray scale 49 to 64) that the image data is (1, 1, 0, 0, 0, 0) to (1, 1, 1, 1, 1, 1).

The bit extending circuit 40, by means of the shift register 43 thereof, extracts the low four bits among the 6-bit image data (h6, h5, h4, h3, h2, h1), adds four bits (0, 0, 0, 0) to the upper side of the low four-bits, and generates 8-bit image data (0, 0, 0, 0, h4, h3, h2, h1). Next, the shift register 43 shifts the values 'h1 ' to 'h4', the low four bits of the 8-bit image data (0, 0, 0, 0, h4, h3, h2, h1), by three bits to the left side so as to make the low three bits be (0, 0, 0) (see FIG. 8). Subsequently, in the adder 44, a previously stored 8-bit data (0, 1, 1, 1, 0, 1, 1, 1) is added to the 8-bit image data (0, h4, h3, h2, h1, 0, 0, 0), which is shifted by the shift register 43. The 8-bit data (0, 1, 1, 1, 0, 1, 1, 1) is offset data and corresponds to offset values for applying the initial values of the 8-bit image data (0, h4, h3, h2, h1, 0, 0, 0) which is shifted by the shift register 43. In other words, the offset data is the data for ensuring continuity between the third and fourth groups. Further, each of the added 8-bit digital data is output from each of the output ports 42*a* to 42*h* as the extended 8-bit image data [b8, b7, b6, b5, b4, b3 (=1), b2 (=1), b1 (=1)]. Here, the upper two bits of the 6-bit image data, which is input to the bit extending circuit 40, are used as bits for determining to which group of the first to fourth groups the 6-bit image data belongs.

Further, as described above, the amount of the bits that are shifted by the shift register 43 is increased toward the fourth group. By doing so, it is possible to rapidly increase the digital data output from the bit extending circuit 40 in a manner of a high order function as the values gets larger.

Figure 9:
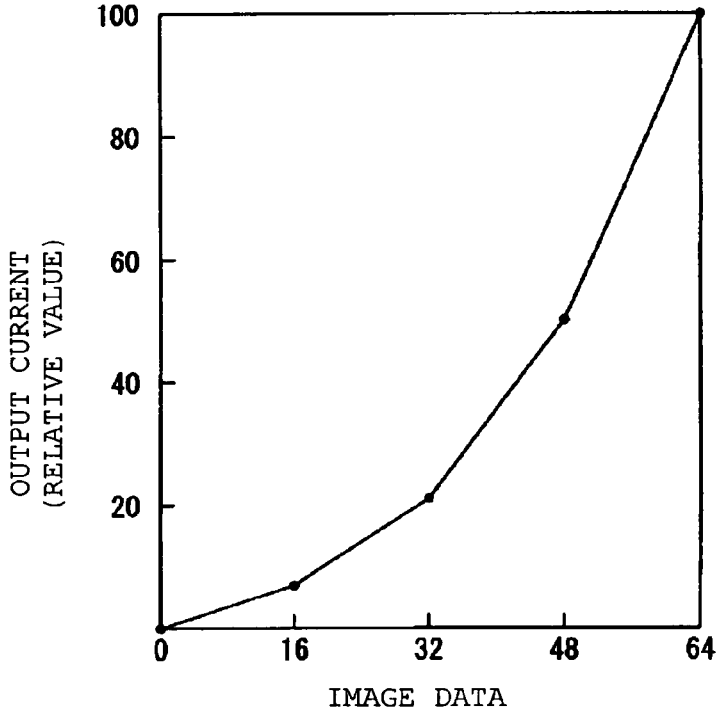
FIG. 9 is a view illustrating relationship between image data and current values of data line driving signals in the present embodiment.

FIG. 9 illustrates the current Im of the data line driving signals output from the analog output terminal Po with respect to the 6-bit image data output from the controller 11. As shown in FIG. 9, it is possible to rapidly increase the current Im of the data line driving signals in a manner of a high order function as the image data output from the controller 11 gets larger. As a result, it is possible to rapidly increase the luminance of the organic EL elements 16 in a manner of a high order function as the luminance gray scale gets higher. Therefore, since the change of the luminance gray scale can be accurately perceived by human beings even in the region having high luminance, it is possible to improve the display quality of the organic EL display 10.

Next, the characteristics of the organic EL display 10 constructed as described above will be described below.

(1) In this embodiment, with respect to the 6-bit image data output from the controller 11, the bit extending circuit 40 is constructed to generate the 8-bit digital data for changing the current Im of the data line driving signals output from the digital-to-analog converting circuit 30 in a manner of a high order function. Further, the single line driver 20 is constructed by connecting the bit extending circuit 40 to the input side of the digital-to-analog converting circuit 30. As a result, it is possible to rapidly increase the luminance of the organic EL elements 16 in a manner of a high order function, as the luminance gray scale gets higher. For this reason, since the change of the luminance gray scale can be accurately perceived by human beings even in the region having high luminance, it is possible to improve the display quality of the organic EL display 10.

(2) In this embodiment, the shift circuit of the bit extending circuit 40 is constructed with the shift register 43. Therefore, the bit extending circuit 40 can be easily constructed without using complicated circuits. Furthermore, it is possible to suppress the increasing of the size of the bit extending circuit 40 by using the shift register 43.

(3) In this embodiment, the amount of the bits that are shifted by the shift register 43 is increased toward the fourth group. Therefore, it is possible to rapidly increase the digital data output from the bit extending circuit 40 in a manner of a high order function as the image data output from the controller 11 get larger. Therefore, it is possible to improve the display quality of the organic EL display 10.

Figure 13:
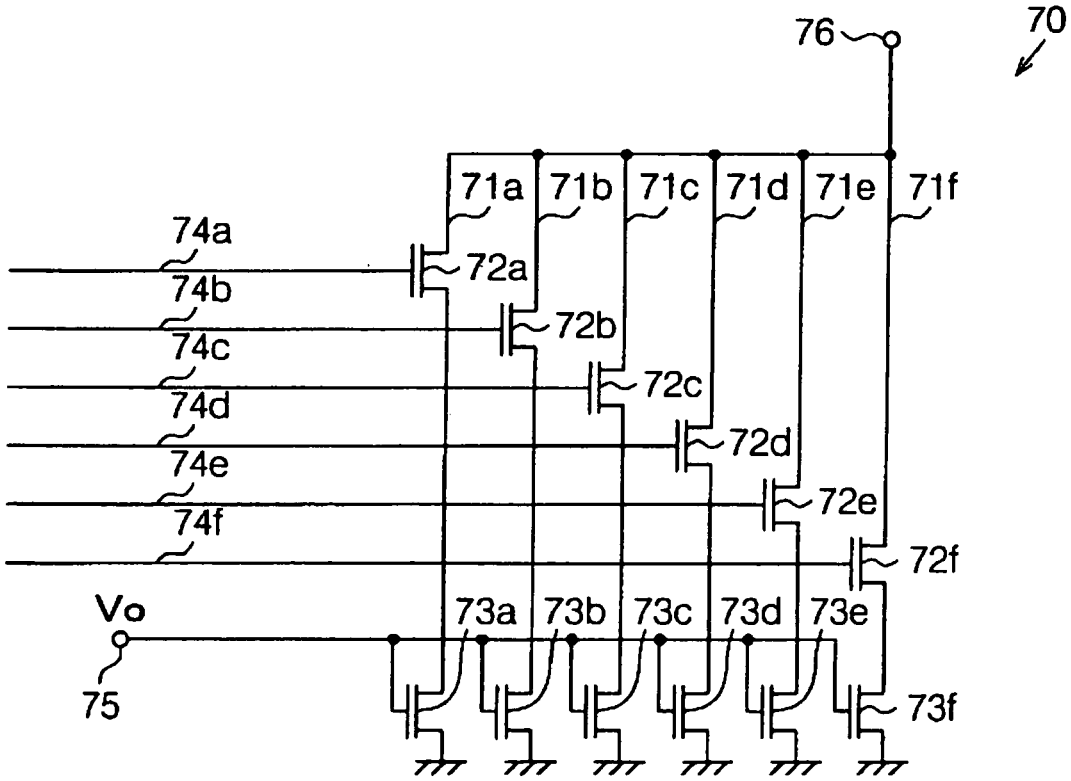
FIG. 13 is a circuit diagram of a digital-to-analog converting circuit which is used in an electro-optical device.

For comparison to the aforementioned embodiment, a single line driver without the bit extending circuit will be described with reference to FIG. 13. FIG. 13 is a circuit diagram of a current output type digital-to-analog converting circuit for outputting analog current (driving current) in accordance with the 6-bit (in 64 gray scales) image data, which is provided to the data line driving circuit.

The digital-to-analog converting circuit 70 includes analog output signal lines 71*a* to 71*f*, switching transistors 72*a* to 72*f*, current supplying transistors 73*a* to 73*f*, and digital input signal lines 74*a* to 74*f*. The analog output signal lines 71*a* to 71*f* are connected in parallel to each other and are connected to an output terminal 76. Each of the analog output signal lines 71*a* to 71*f* is connected to each of the corresponding switching transistors 72*a* to 72*f*. Further, each of the switching transistor 72*a* to 72*f* is connected to each of the corresponding current supplying transistors 73*a* to 73*f*.

Each of the gates of the switching transistors 72*a* to 72*f* is connected to each of the digital input signal lines 74*a* to 74*f*. The digital input signal lines 74*a* to 74*f* are connected to a controller (not shown).

Each of the current supplying transistors 73*a* to 73*f* is a transistor serving as a constant current source for outputting a predetermined current. The relative ratio of gain coefficients β of the current supplying transistors 73*a* to 73*f* is set to be 1:2:4:8:16:32, respectively. In other words, the relative ratio of the current values output from the current supplying transistors 73*a* to 73*f* is 1:2:4:8:16:32, respectively.

The ON/OFF control of the first to sixth current supplying transistors 73*a* to 73*f* is performed by 6-bit image data output from the controller. The lowest bit of the 6-bit image data is supplied to the first current supplying transistors 73*a* having the smallest gain efficient β (in which the relative value of β is 1), and the highest bit is supplied to the sixth current supplying transistors 73*f* having the largest gain efficient β (in which the relative value of β is 32). And then, the ON/OFF control of the switching transistors 72*a* to 72*f* is performed in accordance with the image data output from the controller, and as a result, analog output current is output from the output port 76 in accordance with the image data.

Figure 14:
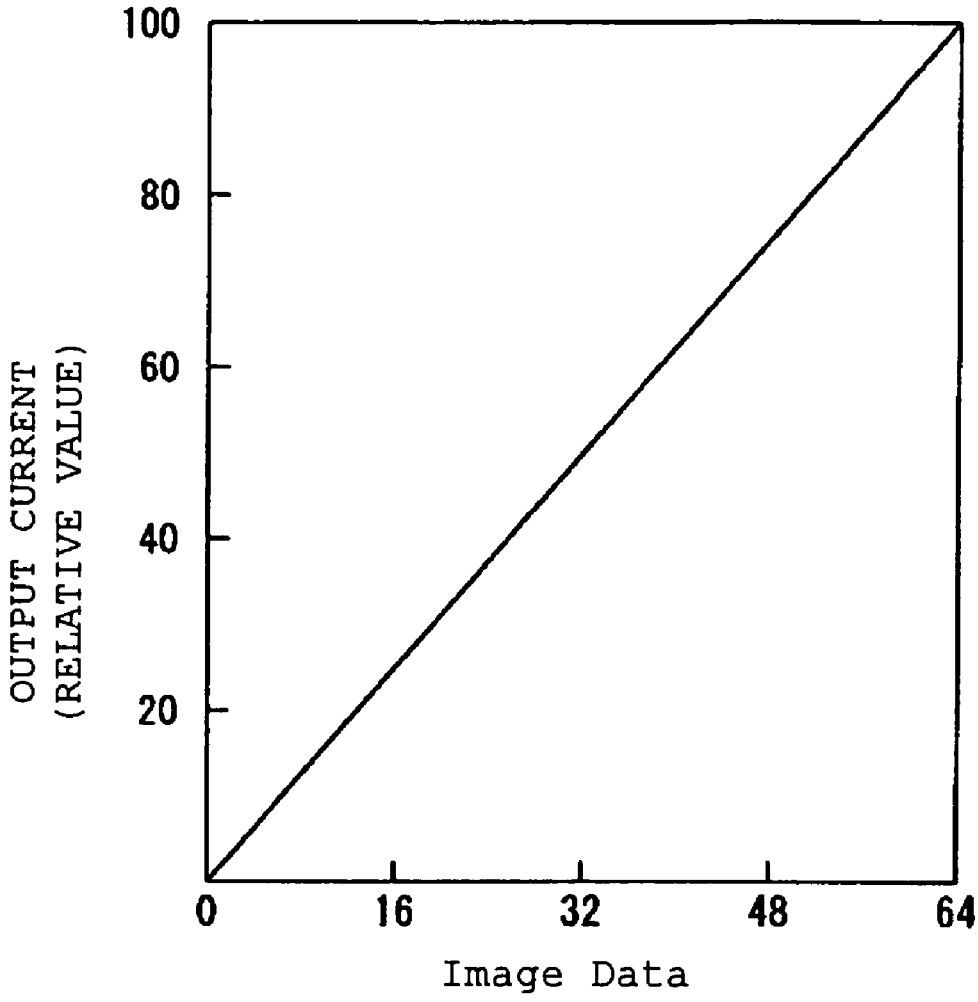
FIG. 14 is a view illustrating relationship between the image data and the current values of the data line driving signals.

As a result, the analog output current output from the output terminal 76 changes linearly with respect to the image data, as shown in FIG. 14. Therefore, since the current corresponding to the analog output current output from the data line driving circuit is supplied to the organic EL elements in the pixel circuit, it is possible that the luminance gray scale of the organic EL elements changes linearly with respect to the image data.

Next, application of the organic EL display 10 as the electro-optical device described in the first embodiment to an electronic apparatus will be described with reference to FIGS. 10 and 11. The organic EL display 10 can be applied to various electronic apparatuses, for example, mobile type personal computers, mobile phones, digital cameras, and the like.

Figure 10:
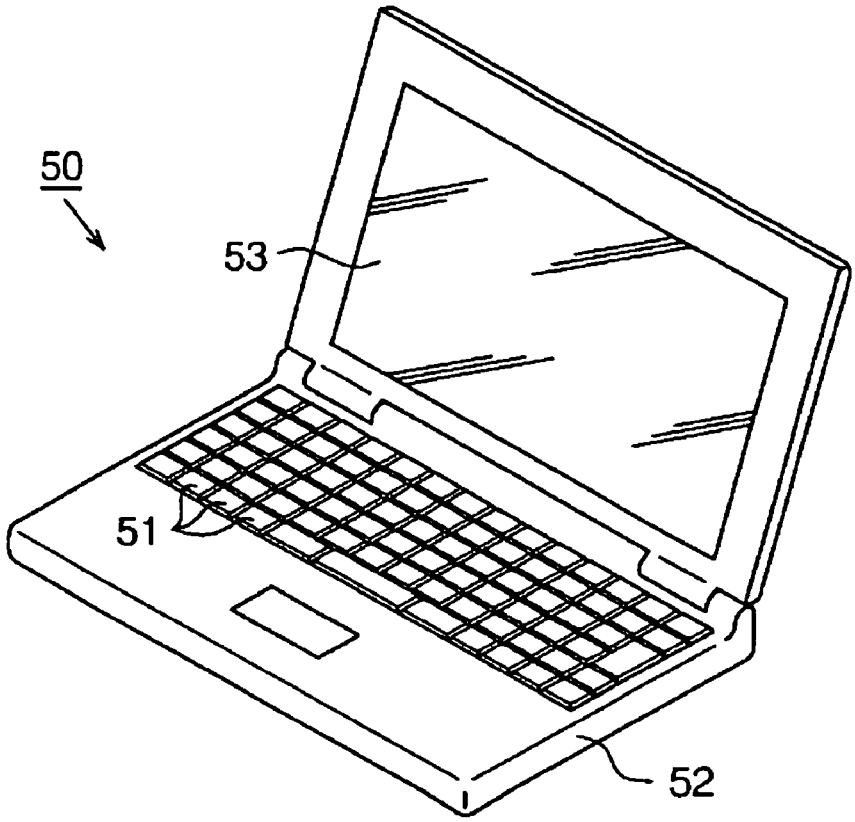
FIG. 10 is a perspective view illustrating construction of a mobile type personal computer for explaining a second embodiment.

FIG. 10 is a perspective view illustrating the construction of a mobile type personal computer. In FIG. 10, the personal computer 50 can include a main body 52 having a keyboard 51, and a display unit 53 which employs the aforementioned organic EL display 10. Also in this case, the display unit 53, which employs the organic EL display 10, has the same effect as the aforementioned embodiment. As a result, it is possible to provide the mobile type personal computer 50 with the display unit 53 having excellent luminance gray scale.

Figure 11:
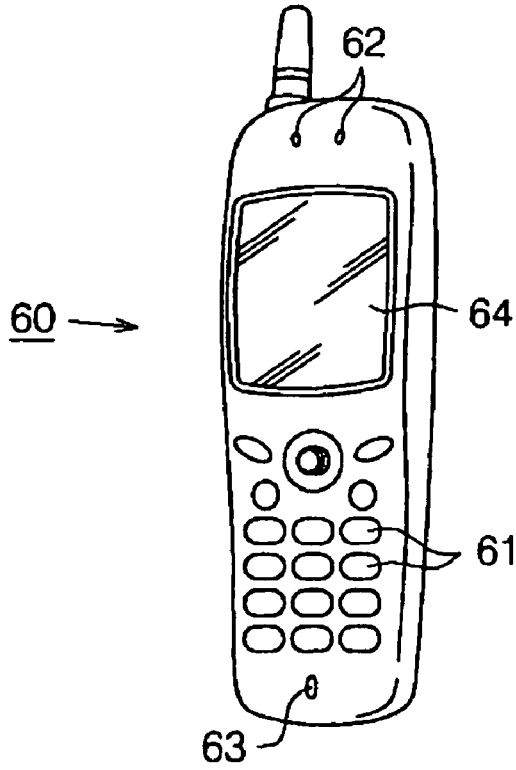
FIG. 11 is a perspective view illustrating construction of a mobile phone for explaining the second embodiment.

FIG. 11 is a perspective view illustrating the construction of a mobile phone. In FIG. 11, the mobile phone 60 can include a plurality of operational buttons 61, an earpiece 62, a mouthpiece 63, and a display unit 64 which employs the aforementioned organic EL display 10. Also in this case, the display unit 64, which employs the organic EL display 10, has the same effect as the aforementioned embodiment. As a result, it is possible to provide the mobile phone 60 with the display unit 64 having excellent luminance gray scale.

Furthermore, it should be understood that the present invention is not limited to the above-described embodiments, and may be implemented as below.

In the aforementioned embodiments, the digital data that is extended by the bit extending circuit 40 is input to the current output type digital-to-analog converting circuit, but, the same effect can be obtained even in the case that the data is input to a voltage output type digital-to-analog converting circuit. In case of using the voltage output type digital-to-analog converting circuit, the application to a voltage-driven electro-optical element such as a liquid crystal element, an electrophoresis element, and an inorganic EL element can be made.

In the aforementioned embodiments, the organic EL elements 16 are used as current driven elements or electro-optical elements, but, the organic EL elements 16 may be applied to light emitting elements such as LED, FED, and SED (Surface-Conduction Electron-Emitter Device), for example.

In the aforementioned embodiments, the image data is 6 bits and the digital-to-analog converting circuit 30 is 8 bits, but, it should be understood that the present invention is not limited to the aforementioned embodiments, so that the image data may be any bits and the digital-to-analog converting circuit 30 my be any bit type.

In the aforementioned embodiments, the data processing at the shift register 43 and the adder 44 of the bit extending circuit 40 is set so that the current Im output from the digital-to-analog converting circuit 30 increase rapidly in a manner of a high order function with regard to the image data. It is possible that the data processing at the shift register 43 and the adder 44 of the bit extending circuit 40 is performed in a different manner from the aforementioned data processing. For example, in the first group the image data of which is (0, 0, 0, 0, 0, 0) to (0, 0, 1, 1, 1, 1), the shift register 43 extracts the low four bits among the image data of the first group, adds four bits (0, 0, 0, 0) to the upper side of the low four-bits, and generates 8-bit image data (0, 0, 0, 0, h4, h3, h2, h1). Next, the shift register 43 shifts the values 'h1' to 'h4', the low four bits of the 8-bit image data (0, 0, 0, 0, h4, h3, h2, h1), by one bit to the left side so as to make the lowest bit be '0'.

Next, in the second group image data of which is (0, 1, 0, 0, 0, 0) to (0, 1, 1, 1, 1, 1), the shift register 43 extracts the low four bits among the image data of the second group, adds four bits (0, 0, 0, 0) to the upper side of the low four bits, and generates 8-bit image data (0, 0, 0, 0, h4, h3, h2, h1). Subsequently, in the adder 44, offset data (0, 0, 0, 1, 1, 1, 1, 1) for ensuring continuity between the first and second groups is added to the 8-bit image data (0, 0, 0, 0, h4, h3, h2, h1), which is shifted by the shift register 43.

Next, in the third group image data of which is (1, 0, 0, 0, 0, 0) to (1, 0, 1, 1, 1, 1), the shift register 43 extracts the low four bits among the image data of the third group, adds four bits (0, 0, 0, 0) to the upper side of the low four bits, and generates 8-bit image data (0, 0, 0, 0, h4, h3, h2, h1). Next, the shift register 43 shifts the values 'h1' to 'h4', the low four bits of the 8-bit image data (0, 0, 0, 0, h4, h3, h2, h1), by one bit to the left side so as to make the lowest bit be '0'. Subsequently, in the adder 44, offset data (0, 0, 1, 1, 0, 0, 0, 0) for ensuring continuity between the second and third groups is added to the 8-bit image data (0, 0, 0, h4, h3, h2, h1, 0) which is shifted by the shift register 43.

Next, in the fourth group image data of which is (1, 1, 0, 0, 0, 0) to (1, 1, 1, 1, 1, 1), the shift register 43 extracts the low four bits among the image data of the fourth group, adds four bits (0, 0, 0, 0) to the upper side of the low four bits, and generates 8-bit image data (0, 0, 0, 0, h4, h3, h2, h1). Subsequently, in the adder 44, offset data (0, 1, 0, 0, 1, 1, 1, 1) for ensuring continuity between the third and fourth groups is added to the 8-bit image data (0, 0, 0, 0, h4, h3, h2, h1), which is shifted by the shift register 43.

Figure 12:
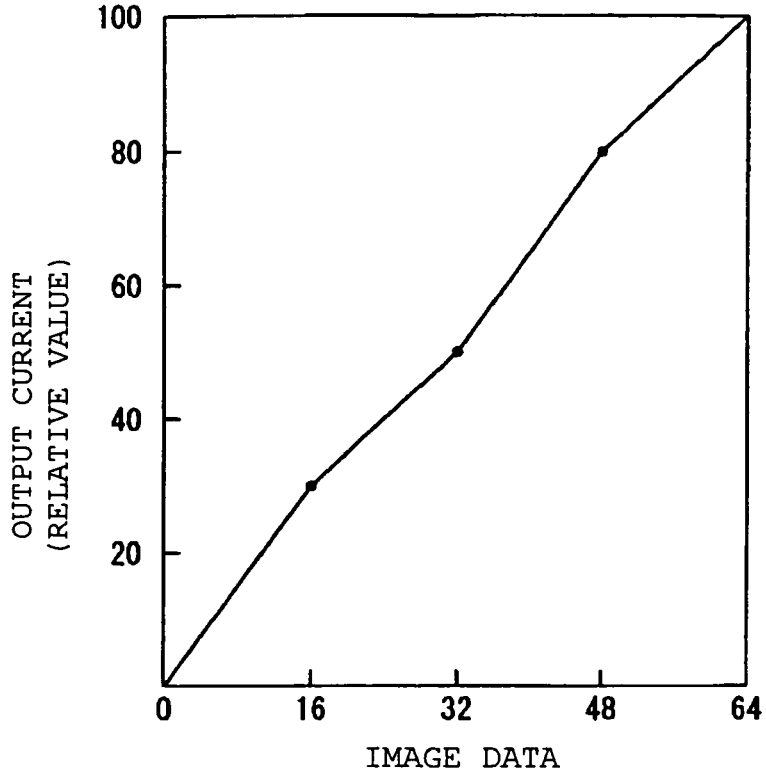
FIG. 12 is a view illustrating relationship between the image data and the current values of the data line driving signals in a modified embodiment.

By doing so, the output current as a function of image data can have points of inflection, as shown in FIG. 12.

What is claimed is:

1. An electronic circuit, comprising:

a shift circuit that shifts j-bit digital data (j is a natural number) to be converted into k-bit digital data (k is a natural number); and a correction circuit that is electrically coupled to the shift circuit, the correction circuit continuously changes the k-bit digital data that is obtained by the shift circuit in accordance with a change of the j-bit digital data, the k-bit digital data being extended digital data which is larger than the j-bit digital data; and the shift circuit classifying a range of the j-bit digital data into a plurality of groups and shifting digital data of each group by a predetermined number of bits in accordance with each group to convert the j-bit digital data into the k-bit digital data.

2. The electronic circuit according to claim 1, the correction circuit being electrically coupled to electro-optical elements;

the j-bit digital data being luminance gray scale data that controls luminance of the electro-optical elements; and the k-bit digital data being extended luminance gray scale data that controls an amount of analog current that is supplied to the electro-optical elements.

3. The electronic circuit according to claim 1, the correction circuit being an adder.

4. The electronic circuit according to claim 1, the shift circuit determining a number of bits by which the j-bit digital data is shifted in accordance with a value of the j-bit digital data.

5. The electronic circuit according to claim 4, the shift circuit performing shifting to an upper side so that a larger value group is shifted by a larger number of bits.

6. An electro-optical device, comprising:

a control circuit that outputs j-bit luminance gray scale data (j is a natural number);

a driving circuit that generates analog driving signals based on the j-bit luminance gray scale data; and a pixel circuit that drives current driven elements based on the analog driving signals, the driving circuit including:

a shift circuit that shifts the j-bit luminance gray scale data to convert the j-bit luminance gray scale data into k-bit digital data (k is a natural number);

a correction circuit that is electrically coupled to the shift circuit, the correction circuit continuously changing the k-bit digital data that is obtained by the shift circuit in accordance with a change of the j-bit luminance gray scale data, the k-bit digital data being extended digital data that is larger than the j-bit luminance gray scale data; and the shift circuit classifying a range of the j-bit luminance gray scale data into a plurality of groups and shifting digital data of each group by a predetermined number of bits in accordance with each group to convert the j-bit luminance gray scale data into the k-bit digital data.

7. The electra-optical device according to claim 6, the correction circuit being an adder.

8. The electro-optical device according to claim 6, the shift circuit determining a number of bits by which the j-bit luminance gray scale data is shifted in accordance with a value of the j-bit luminance gray scale data.

9. The electra-optical device according to claim 8, the shift circuit performing shifting to an upper side so that a larger value group is shifted by a larger number of bits.

10. The electra-optical device according to claim 6, the current driven elements being EL elements.

11. The electra-optical device according to claim 10, the EL elements including light emitting layers made of organic materials.

* * * * *